US010619928B2

(12) United States Patent
Takahashi

(10) Patent No.: US 10,619,928 B2
(45) Date of Patent: Apr. 14, 2020

(54) CONDUCTIVE METAL MELTING FURNACE, CONDUCTIVE METAL MELTING FURNACE SYSTEM EQUIPPED WITH SAME, AND CONDUCTIVE METAL MELTING METHOD

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 212 days.

(21) Appl. No.: 15/578,884

(22) PCT Filed: May 31, 2016

(86) PCT No.: PCT/JP2016/066055

§ 371 (c)(1),
(2) Date: Dec. 1, 2017

(87) PCT Pub. No.: WO2016/194910

PCT Pub. Date: Dec. 8, 2016

(65) Prior Publication Data

US 2018/0164037 A1 Jun. 14, 2018

(30) Foreign Application Priority Data

Jun. 3, 2015 (JP) ..... 2015-113138

(51) Int. Cl.
*F27D 27/00* (2010.01)
*B22D 1/00* (2006.01)
(Continued)

(52) U.S. Cl.
CPC ..... *F27D 27/00* (2013.01); *B01F 13/0809* (2013.01); *B22D 1/00* (2013.01);
(Continued)

(58) Field of Classification Search
CPC ..... F27D 27/00
(Continued)

(56) References Cited

U.S. PATENT DOCUMENTS 8,158,055 B2 * 4/2012 Takahashi ..... B01F 5/102 266/234
9,488,415 B2 11/2016 Takahashi
(Continued)

FOREIGN PATENT DOCUMENTS

CA 2 549 629 A1 12/2007
CN 1793765 A 6/2006
(Continued)

OTHER PUBLICATIONS

Extended European Search Report dated May 17, 2018 in European Patent Application No. 16803344.7, citing documents AA, AB, AO through AS, and AX therein, 9 pages.
(Continued)

*Primary Examiner* — Scott R Kastler
(74) *Attorney, Agent, or Firm* — Oblon, McClelland, Maier & Neustadt, L.L.P.

(57) ABSTRACT

To provide a technique that reliably and quickly melts conductive metal, there is provided a conductive metal melting method including: rotating a magnetic field device formed of a permanent magnet, which includes a permanent magnet, about a vertical axis near a driving flow channel of a flow channel that includes an inlet through which conductive molten metal flows into the flow channel from the outside and an outlet through which the molten metal is discharged to the outside and includes a vortex chamber provided between the driving flow channel provided on an upstream side and an outflow channel provided on a downstream side, and moving lines of magnetic force of the permanent magnet while the lines of magnetic force of the permanent magnet pass through the molten metal present in the driving flow channel; allowing the molten metal to flow into the vortex chamber by an electromagnetic force generated with the movement to generate the vortex of the molten metal in the vortex chamber into which the raw material is
(Continued)

to be put; and discharging the molten metal to the outside from the outlet. The conductive metal melting method further includes driving the molten metal present in the outflow channel toward the outlet by an electromagnetic force generated with the movement of the lines of magnetic force as necessary.

11 Claims, 6 Drawing Sheets

(51) Int. Cl.

| | |
|---|---|
| ***C22B 9/00*** | (2006.01) |
| ***F27B 3/10*** | (2006.01) |
| ***F27B 3/04*** | (2006.01) |
| ***B22D 45/00*** | (2006.01) |
| ***B01F 13/08*** | (2006.01) |
| ***C22B 21/00*** | (2006.01) |
| ***F27B 14/08*** | (2006.01) |
| *F27D 3/00* | (2006.01) |

(52) U.S. Cl.
CPC ..... *B22D 45/00* (2013.01); *C22B 9/00* (2013.01); *C22B 21/0084* (2013.01); *F27B 3/04* (2013.01); *F27B 3/10* (2013.01); *F27B 14/0806* (2013.01); *B01F 2215/0075* (2013.01); *F27D 2003/0054* (2013.01)

(58) Field of Classification Search
USPC ..... 266/234
See application file for complete search history.

(56) References Cited

U.S. PATENT DOCUMENTS

| | | | |
|---|---|---|---|
| 9,597,726 | B2 | 3/2017 | Takahashi |
| 2006/0133194 | A1 | 6/2006 | Takahashi |
| 2010/0244338 | A1 | 9/2010 | Takahashi |
| 2011/0197709 | A1 | 8/2011 | Koriyama et al. |
| 2011/0248432 | A1 | 10/2011 | Takahashi |
| 2012/0104669 | A1 | 5/2012 | Takahashi |
| 2013/0320602 | A1 | 12/2013 | Isidorov et al. |
| 2014/0079561 | A1 | 3/2014 | Takahashi |
| 2018/0164037 | A1* | 6/2018 | Takahashi ..... B22D 1/00 |

FOREIGN PATENT DOCUMENTS

| | | | |
|---|---|---|---|
| CN | 103575121 | A | 2/2014 |
| CN | 103712443 | A | 4/2014 |
| CN | 204007188 | U | 12/2014 |
| EP | 2 206 998 | A2 | 7/2010 |
| EP | 2 206 998 | A3 | 7/2010 |
| EP | 2 708 839 | A1 | 3/2014 |
| JP | 07-301490 | A | 11/1995 |
| JP | 2006-189229 | A | 7/2006 |
| JP | 2008-196807 | A | 8/2008 |
| JP | 4376771 | B2 | 12/2009 |
| JP | 4413786 | B2 | 2/2010 |
| JP | 2010-169381 | A | 8/2010 |
| JP | 2011-12951 | A | 1/2011 |
| JP | 2011-230187 | A | 11/2011 |
| JP | 2012-137272 | A | 7/2012 |

OTHER PUBLICATIONS

Gräb, H.-W., et al., "New Developments in the Design of Twin Chamber Aluminum Melting Furnaces", World of Metallurgy—Erzmetall, GDMB-Medieverlag, XP001514870, vol. 61 No. 2, Mar. 1, 2008, pp. 104-108.

International Search Report dated Aug. 9, 2016 in PCT/JP2016/066055, filed on May 31, 2016.

Office Action dated Nov. 16, 2018 in Korean Patent Application No. 10-2017-7036044, citing document AO therein, 13 pages (with unedited computer generated English translation).

Combined Chinese Office Action and Search Report dated Jan. 24, 2019 in Patent Application No. 201680029945.3 (with partial English translation and English translation of category of cited documents), citing documents AO-AR therein, 10 pages.

* cited by examiner

CONDUCTIVE METAL MELTING FURNACE, CONDUCTIVE METAL MELTING FURNACE SYSTEM EQUIPPED WITH SAME, AND CONDUCTIVE METAL MELTING METHOD

BACKGROUND OF THE INVENTION

Field of the Invention

The present invention relates to a conductive metal melting furnace, a conductive metal melting furnace system including the conductive metal melting furnace, and a conductive metal melting method, and relates to a melting furnace for conductive metal, such as non-ferrous metal (conductor (conductive body), such as, Al, Cu, Zn, an alloy of at least two of these, or an Mg alloy)) or ferrous metal, a conductive metal melting furnace system including the melting furnace, and a conductive metal melting method.

Background Art

In the past, there have been Patent Document 1 and Patent Document 2 as various devices that stir molten metal of aluminum or the like as conductive metal. These devices are to improve the quality of aluminum or the like and to obtain ingots having uniform quality by stirring aluminum or the like. However, it is important to stir metal melted in advance, but it is also actually necessary to stir molten metal present in, for example, a holding furnace while melting aluminum chips and the like as raw materials.

CITATION LIST

Patent Literature

Patent Document 1: Japanese Patent No. 4376771
Patent Document 2: Japanese Patent No. 4413786

SUMMARY OF THE INVENTION

Technical Problem

The invention has been made in consideration of the above-mentioned circumstances, and an object of the invention is to provide a conductive metal melting furnace that can more quickly melt raw materials, such as aluminum, and a conductive metal melting furnace system including the conductive metal melting furnace.

Solution to Problem

The invention provides a conductive metal melting furnace that melts a raw material of conductive metal to form molten metal, the conductive metal melting furnace includes a flow channel that includes an inlet through which the conductive molten metal flows into the flow channel from the outside and an outlet through which the molten metal is discharged to the outside and a magnetic field device formed of a permanent magnet that includes a permanent magnet and is rotatable about a vertical axis, the flow channel includes a driving flow channel that is provided on an upstream side and a vortex chamber that is provided on a downstream side, and the driving flow channel is provided at a providing position, wherein the providing position is a position which is close to the magnetic field device formed of a permanent magnet, and wherein the providing position is a position at which lines of magnetic force of the magnetic field device formed of a permanent magnet are moved with the rotation of the magnetic field device formed of a permanent magnet while passing through the molten metal present in the driving flow channel and the molten metal is allowed to flow into the vortex chamber by an electromagnetic force generated with the movement of the lines of magnetic force to generate the vortex of the molten metal in the vortex chamber.

Further, the invention provides a conductive metal melting system that includes the conductive metal melting furnace and a holding furnace for storing molten metal, and the inlet and the outlet of the conductive metal melting furnace communicate with an outflow port and an inflow port, which are formed in a side wall of the holding furnace, respectively.

Furthermore, the invention provides a conductive metal melting method that melts a raw material of conductive metal to form molten metal, and the conductive metal melting method includes:

rotating a magnetic field device formed of a permanent magnet, which includes a permanent magnet, about a vertical axis near a driving flow channel of a flow channel that includes an inlet through which conductive molten metal flows into the flow channel from the outside and an outlet through which the molten metal is discharged to the outside and includes the driving flow channel provided on an upstream side and a vortex chamber provided on a downstream side, and moving lines of magnetic force of the permanent magnet while the lines of magnetic force of the permanent magnet pass through the molten metal present in the driving flow channel; allowing the molten metal to flow into the vortex chamber by an electromagnetic force generated with the movement to generate the vortex of the molten metal in the vortex chamber into which the raw material is to be put; and discharging the molten metal to the outside from the outlet.

DETAILED DESCRIPTION OF THE INVENTION

A conductive metal melting system 100 according to an embodiment of the invention includes a melting furnace 1 that is made of a refractory and a holding furnace 2 which is made of a refractory likewise and to which the melting furnace 1 is attached. Conductive molten metal M is guided to the melting furnace 1 from the holding furnace 2, and a strong vortex is generated by the melting furnace 1. Raw materials of conductive metal, for example, raw materials, such as aluminum chips, empty aluminum cans, and aluminum scraps, are put into the strong vortex, and are reliably melted. After melting, the molten metal M is allowed to flow so as to return to the holding furnace 2 from the melting furnace 1. An electromagnetic force, which is generated by the rotation of a magnetic field device 3 formed of a permanent magnet, is used as power that is required for the flow. Non-ferrous metal and iron are used as the conductive metal, and non-ferrous metal (conductor (conductive body), such as, Al, Cu, Zn, an alloy of at least two of these, or an Mg alloy)), ferrous metal, and the like are used as the conductive metal.

Further, in the embodiment of the invention, the vortex is generated by only the rotation of the magnetic field device 3 formed of a permanent magnet. The physical structure of the melting furnace 1, particularly, the structure of a flow channel in which molten metal M flows, and the structure of a so-called gathering spot for the molten metal M for generating a vortex will be devised as described below so that the vortex becomes strong. Accordingly, in the embodiment of the invention unlike in a case in which large current flows in an electromagnet, a strong vortex of molten metal M is generated with small energy consumption required for only the rotation of the magnetic field device 3 formed of a permanent magnet and raw materials can be reliably melted by this vortex.

The embodiment of the invention will be described in detail below.

The holding furnace 2 of the embodiment of the invention is to hold molten metal M, which is in a melted state, in the melted state as in a general-purpose holding furnace, and includes various overheating device (not illustrated), such as a burner. Since others of the holding furnace 2 are the same as those of the general-purpose holding furnace, the detailed description thereof will be omitted.

Figure 1:
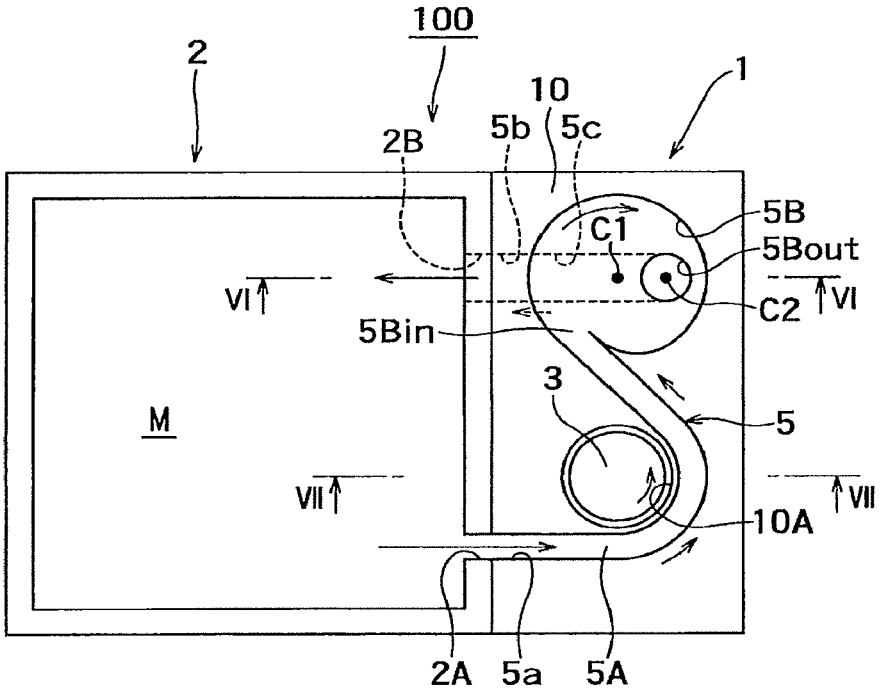
FIG. 1 is a plan view of a conductive metal melting system according to an embodiment of the invention.

As particularly known from FIG. 1, the melting furnace 1 attached to the holding furnace 2 includes a body 10 that is made of a refractory material and the magnetic field device 3 formed of a permanent magnet. A flow channel 5 for molten metal M is formed in the body 10, an upstream portion of the flow channel 5 forms a driving flow channel 5A, a downstream portion of the flow channel 5 forms an outflow channel 5C, and a vortex chamber 5B is formed in the middle of the flow channel 5. The magnetic field device 3 formed of a permanent magnet is provided in a magnetic-field-device storage chamber 10A, which is formed near the driving flow channel 5A, so as to be rotatable about a vertical axis.

Figure 5A:
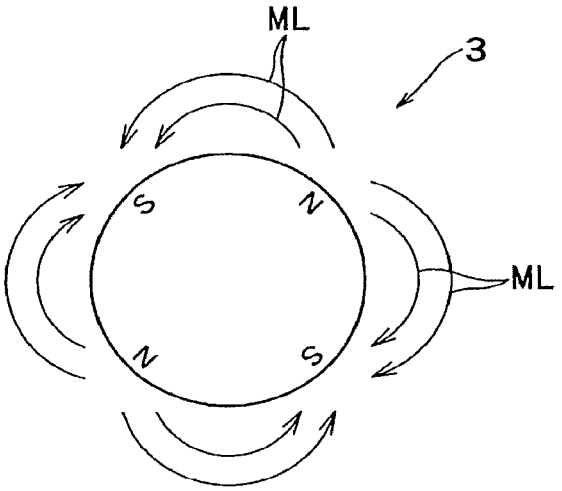
FIG. 5(A) is a plan view of an example of a magnetic field device that is illustrated in FIG. 1 and formed of a permanent magnet.
Figure 5B:
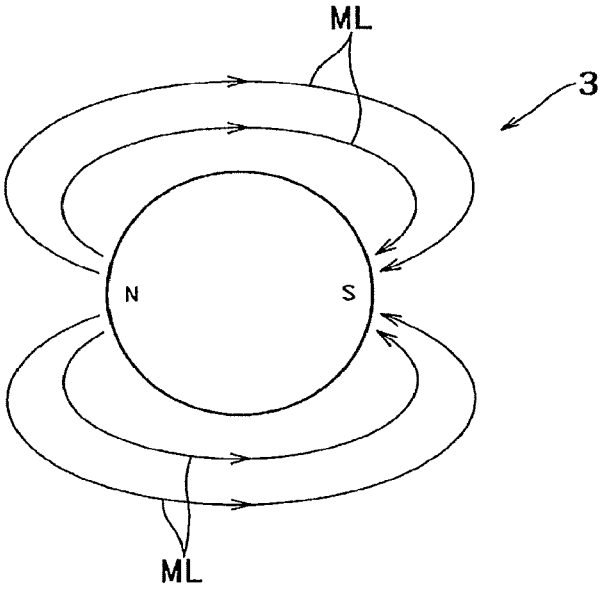
FIG. 5(B) is a plan view of another example of a magnetic field device that is illustrated in FIG. 1 and formed of a permanent magnet.

That is, the melting furnace 1 includes a so-called vertical rotating magnetic field device 3, which is formed of a permanent magnet and is rotated about a substantially vertical axis, as a drive source that drives molten metal M. The magnetic field device 3 formed of a permanent magnet forms a magnetic field around itself as illustrated in, for example, FIGS. 5(A) and 5(B). Specifically, for example, a device disclosed in FIGS. 2 and 3 of Patent Document 1 or a device disclosed in FIGS. 1 and 2 of Patent Document 2 can be used. That is, the magnetic field device 3 formed of a permanent magnet is formed of one permanent magnet or a plurality of permanent magnets. Since the magnetic field device 3 formed of a permanent magnet is rotated about the vertical axis, lines ML of magnetic force generated from the magnetic field device 3 formed of a permanent magnet are rotationally moved while reliably passing through the molten metal M present in the driving flow channel 5A to be described below and the molten metal M is driven toward the vortex chamber 5B in the driving flow channel 5A by an electromagnetic force that is caused by eddy current.

That is, the molten metal M present in the holding furnace 2 is sucked into the flow channel 5 of the melting furnace 1 and accelerated by an electromagnetic force generated in accordance with the same principle as those of Patent Documents 1 and 2 through the rotation of the magnetic field device 3 formed of a permanent magnet, forms a vortex, and then returns to the holding furnace 2. Since the vortex chamber 5B is formed so that the upper side of the vortex chamber 5B is opened, and raw materials are put into the vortex, which is present in the vortex chamber 5B, from a raw-material supply device (not illustrated), such as a hopper, from the upper side.

Figure 2:
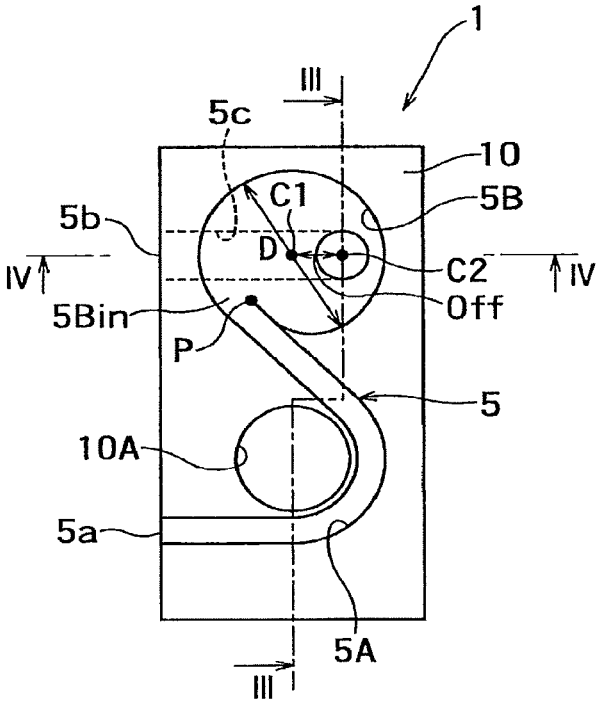
FIG. 2 is a plan view of a conductive metal melting furnace of FIG. 1.

In more detail, as particularly known from FIG. 2, the melting furnace 1 includes the flow channel 5 that includes an inlet 5*a* and an outlet 5*b*. The inlet 5*a* communicates with an outflow port 2A of the holding furnace 2 illustrated in FIG. 1, and the outlet 5*b* communicates with an inflow port 2B of the holding furnace 2 illustrated in FIG. 1.

As particularly known from FIG. 2, the upstream portion of the flow channel 5 forms the driving flow channel 5A including an arc-shaped portion of which the cross-section is curved in a semicircular shape, and the vortex chamber 5B having the shape of a substantially columnar groove is provided on the downstream side of the flow channel 5. As illustrated in FIG. 2, the driving flow channel 5A is formed of a flow channel that is narrow in plan view. Accordingly, as briefly described above, the lines ML of magnetic force generated from the magnetic field device 3 formed of a permanent magnet reliably pass through the molten metal M present in the driving flow channel 5A. Therefore, the molten metal M, which is present in the driving flow channel 5A, is reliably driven toward the vortex chamber 5B with the rotation of the magnetic field device 3 formed of a permanent magnet about the vertical axis. That is, the driving flow channel 5A includes the arc-shaped portion that is curved in an arc shape.

Figure 6:
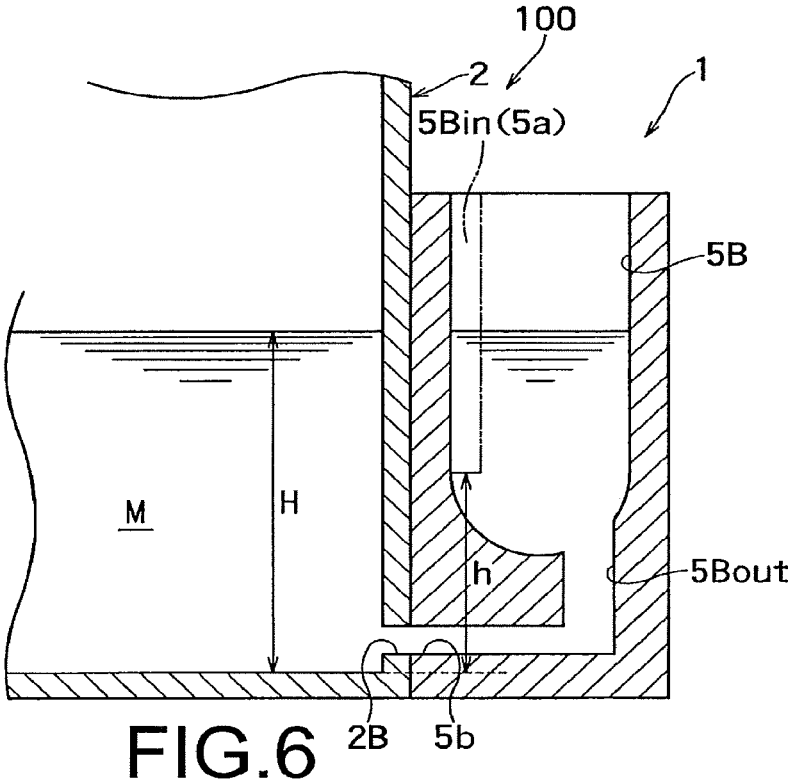
FIG. 6 is a cross-sectional view taken along line VI-VI of FIG. 1.

Further, as known from FIG. 6, the height h of the inlet 5*a* (vortex chamber inlet 5Bin) of the flow channel 5 is set to be lower than the height H of the normal molten metal M present in the holding furnace 2. Accordingly, the molten metal M is also allowed to flow into the melting furnace 1 (vortex chamber 5B) from the holding furnace 2 by potential energy.

As particularly known from FIG. 2, an end of the driving flow channel 5A communicates with the vortex chamber 5B (vortex chamber inlet 5Bin). That is, in plan view, in FIG. 2, a tangent at one point P on a circle on the outer peripheral side of the vortex chamber 5B and the end portion of the driving flow channel 5A are connected to each other so as to substantially correspond to each other. Accordingly, the molten metal M present in the driving flow channel 5A flows into the vortex chamber 5B along the circumference of the vortex chamber 5B at an angle, which is suitable for the formation of a vortex, and forms a vortex that is reliably rotated with a high speed clockwise in FIG. 2.

As particularly known from FIG. 6, a vortex chamber outlet 5Bout is formed at the bottom of the vortex chamber 5B. The vortex chamber outlet 5Bout reaches the outlet 5*b* of the flow channel 5, and the outlet 5*b* communicates with the inflow port 2B of the holding furnace 2 as described above. As particularly known from FIG. 2, the center C2 of the vortex chamber outlet 5Bout is offset from the center C1 of the vortex chamber 5B by an offset distance Off. Accordingly, the molten metal M easily flows out of the vortex chamber outlet 5Bout after the molten metal M is rotated in the vortex chamber 5B clockwise in FIG. 2.

Figure 3:
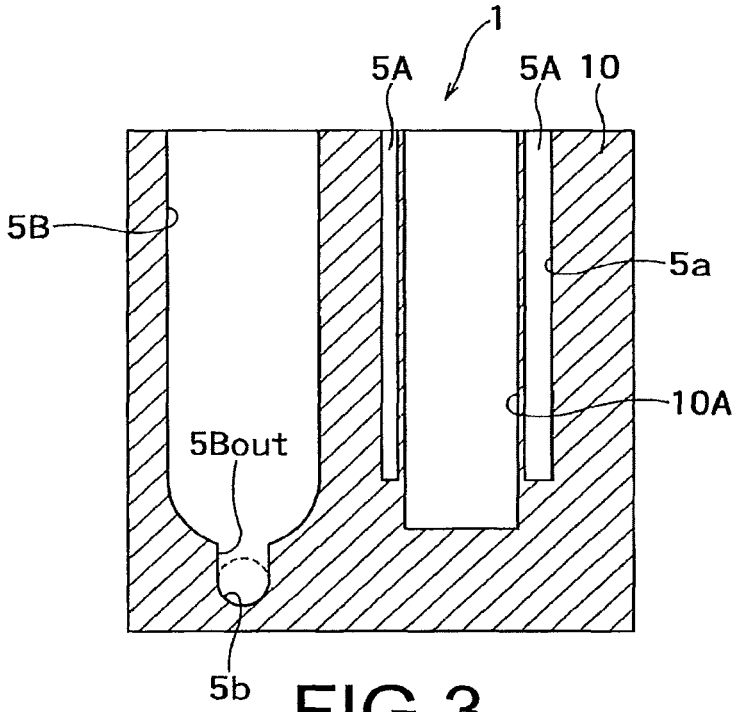
FIG. 3 is a cross-sectional view taken along line of FIG. 2.
Figure 4:
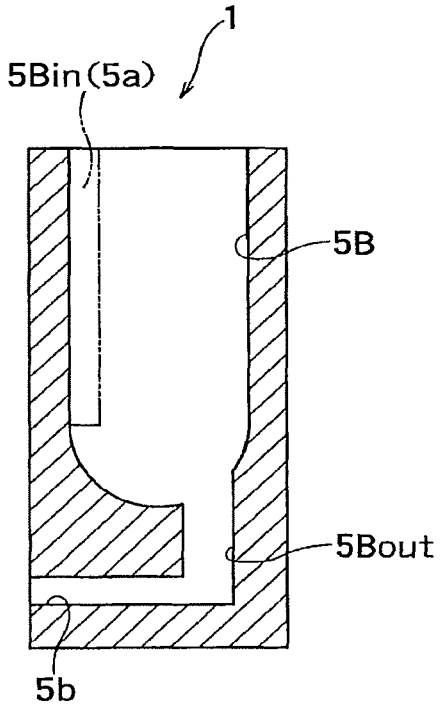
FIG. 4 is a cross-sectional view taken along line IV-IV of FIG. 2.
Figure 7:
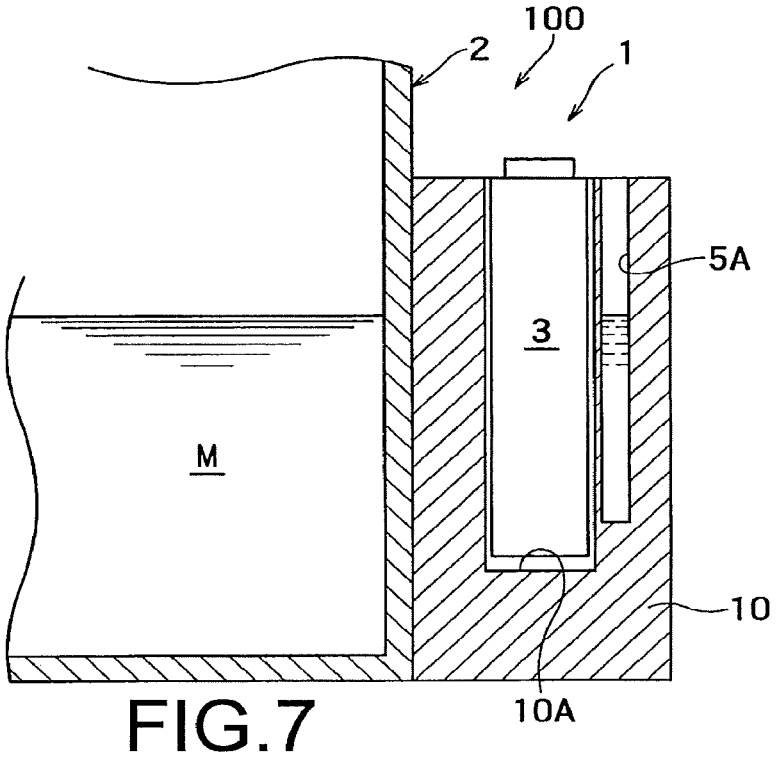
FIG. 7 is a cross-sectional view taken along line VII-VII of FIG. 1.

As particularly known from FIG. 3, a magnetic-field-device storage chamber 10A, which stores the magnetic field device 3 formed of a permanent magnet, is formed in the body 10 of the melting furnace 1. The magnetic-field-device storage chamber 10A is formed of an independent chamber, and is provided at a position along the inside of the curved driving flow channel 5A as particularly known from FIG. 2. As illustrated in FIG. 7, the magnetic field device 3 formed of a permanent magnet is stored in the magnetic-field-device storage chamber 10A so as to be rotatable about a substantially vertical axis. Various drive mechanisms can be employed as a drive mechanism for the magnetic field device 3 formed of a permanent magnet. For example, a drive mechanism, of which the rotational speed is variable and the rotational direction can also be reversed, can be employed. Since a general-purpose drive mechanism can be employed as the drive mechanism, the detailed description of the drive mechanism will be omitted here.

In this way, the magnetic field device 3 formed of a permanent magnet is installed in the magnetic-field-device storage chamber 10A so as to be close to the molten metal M present in the driving flow channel 5A as much as possible. Accordingly, the lines ML of magnetic force of the magnetic field device 3 formed of a permanent magnet sufficiently pass through the molten metal M, which is present in the driving flow channel 5A, in plan view. Therefore, when the magnetic field device 3 formed of a permanent magnet is rotated counterclockwise in FIG. 1 as known from FIG. 1, the molten metal M present in the driving flow channel 5A is reliably driven and flows into the vortex chamber 5B in a tangential direction of the outer periphery of the magnetic field device 3. As a result, a strong clockwise vortex of the molten metal M is formed in the vortex chamber 5B. When raw materials are put into the vortex chamber 5B from the upper side of the vortex chamber 5B by, for example, a hopper (not illustrated), the raw materials are reliably sucked into the vortex and are quickly and reliably melted. The molten metal M of which the amount has been increased flows out of the vortex chamber 5B through the vortex chamber outlet 5Bout, and finally flows into the holding furnace 2. At the same time as the inflow of the molten metal M, the molten metal M, which is in a melted state, is sucked into the driving flow channel 5A from the holding furnace 2.

As described above, in the embodiment of the invention, the molten metal M present in the driving flow channel 5A is driven and allowed to flow into the vortex chamber 5B by the rotation of the magnetic field device 3 formed of a permanent magnet and forms the strong vortex of the molten metal M in the vortex chamber 5B. When raw materials are put into the vortex, the raw materials can be sucked into the center of the vortex, be quickly and reliably melted, and be discharged to the holding furnace 2.

Meanwhile, actual dimensions and actual specifications of main parts of an example of the above-mentioned device were set as described below. First, the height H of the molten metal M present in the holding furnace 2 was set to the range of 650 to 1000 mm that is a normal value. The actual dimensions and the like of each parts of the melting furnace 1 are to be determined depending on an organic relationship between three items, that is, the amount of molten metal flowing into the vortex chamber 5B through the vortex chamber inlet 5Bin, the amount of molten metal flowing out of the vortex chamber 5B through the vortex chamber outlet 5Bout, and the diameter of the vortex chamber 5B. As a result, the height h of the vortex chamber inlet 5Bin was set to the range of 150 to 300 mm, the amount W of inflow was set to the range of 500 to 900 ton/hour, the diameter D of the vortex chamber 5B was set to the range of ϕ600 to ϕ700 mm, the diameter d of the vortex chamber outlet 5Bout was set to the range of ϕ150 to ϕ200 mm, and an offset value Off between the center C1 of the vortex chamber 5B and the center C2 of the vortex chamber outlet 5Bout was set to the range of 50 to 100 mm. When these numerical values are set, molten metal M can also be allowed to smoothly flow into and out of the vortex chamber 5B in terms of potential energy.

Moreover, in the embodiment of the invention, a vortex is not directly formed by the rotation of the magnetic field device 3 formed of a permanent magnet, molten metal M is driven in the driving flow channel 5A so as to be reliably accelerated and is allowed to flow into the vortex chamber 5B to form a vortex, and the molten metal M is allowed to flow out of the vortex chamber outlet 5Bout in the direction corresponding to the flow of a vortex. Accordingly, the vortex of the molten metal M can be made strong, and raw materials can be efficiently and reliably melted and be discharged to the holding furnace 2.

Further, the conductive metal melting furnace 1 and the holding furnace 2 can also be formed as a set from the beginning in the conductive metal melting system 100 according to the embodiment of the invention, but the conductive metal melting furnace 1 can be attached to the existing holding furnace 2 to form the conductive metal melting system 100.

Figure 8:
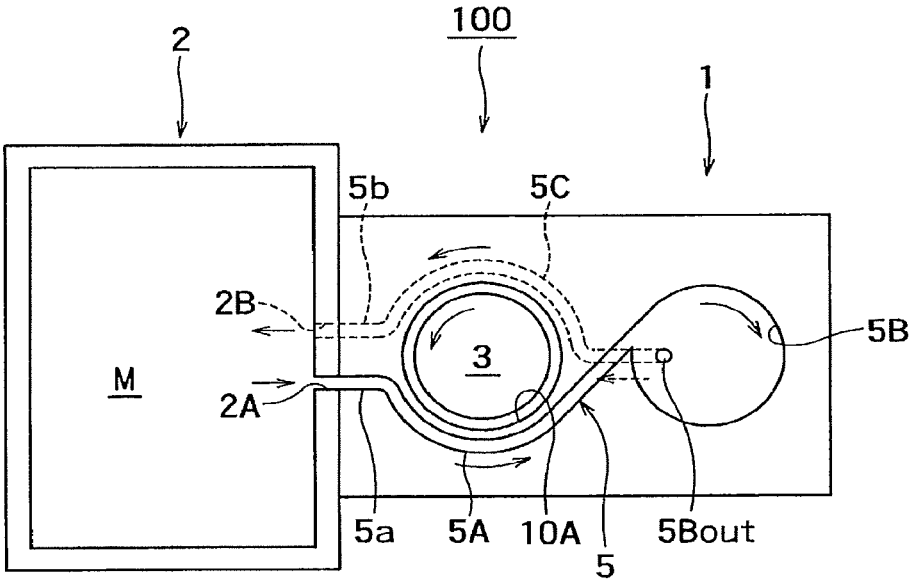
FIG. 8 is a plan view of a conductive metal melting system according to another embodiment of the invention.
Figure 9:
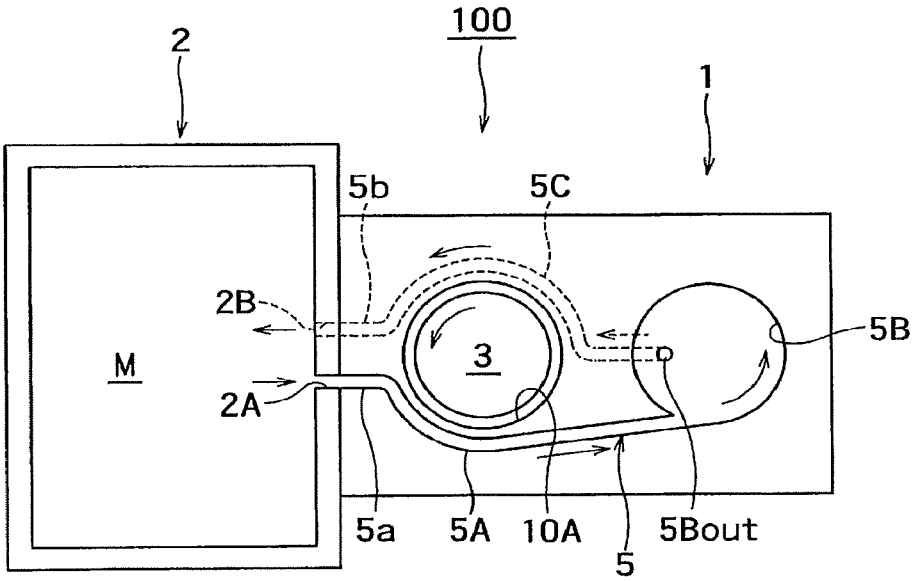
FIG. 9 is a plan view of a conductive metal melting system according to still another embodiment of the invention.
Figure 10:
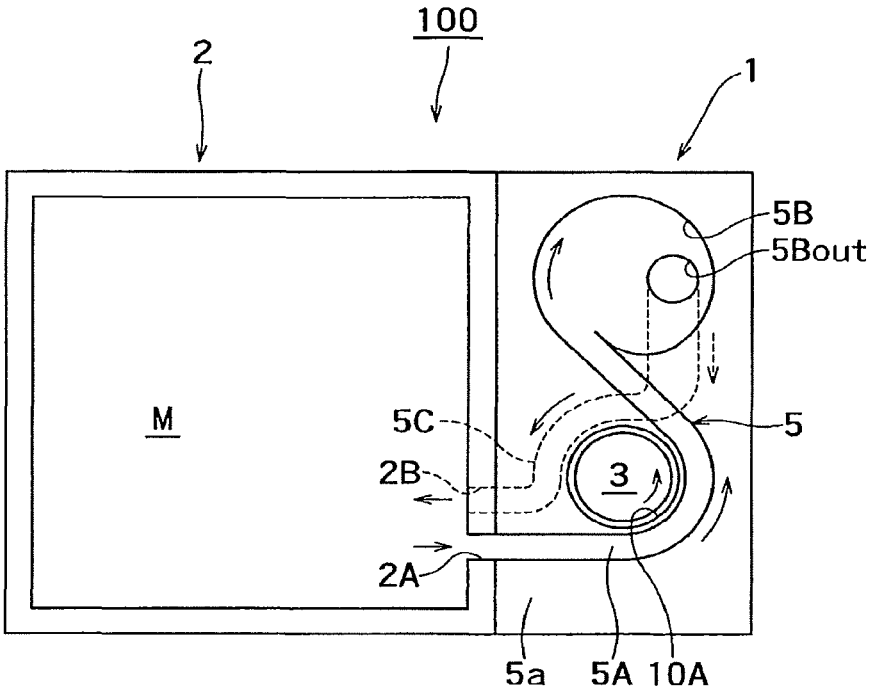
FIG. 10 is a plan view of a conductive metal melting system according to yet another embodiment of the invention.

FIGS. 8 to 10 are plan views illustrating other embodiments of the invention, respectively. These embodiments are adapted so that molten metal is pressed on the inlet side of a vortex chamber 5B and is sucked on the outlet side thereof. In more detail, a drive force, which is caused by an electromagnetic force generated by the magnetic field device 3 formed of a permanent magnet, is applied to not only molten metal M flowing into the vortex chamber 5B but also molten metal M flowing out of the vortex chamber 5B. That is, in this embodiment, from the point of view of the vortex chamber 5B, molten metal M is allowed to forcibly flow (be pressed) into the vortex chamber 5B by an electromagnetic force and is forcibly pulled out (sucked) from the vortex chamber 5B by a pulling force that is caused by an electromagnetic force, and the molten metal present in the vortex chamber 5B is more strongly rotated by the cooperation of these two forces (a pressing force and a suction force). For example, when the cross-sectional area of the outlet 5*b* is smaller than that of the inlet 5*a* in the conductive metal melting furnace 1, an effect is more expected.

Further, the structure of each of the embodiments of FIGS. 8 to 10 is different from the structure of the embodiment of FIG. 1 in that an outflow channel 5C directed to the holding furnace 2 from the vortex chamber 5B is laterally and linearly formed in FIG. 1, but is curved so as to be positioned near the magnetic field device 3 formed of a permanent magnet in the embodiments of FIGS. 8 to 10. Other structures of each of the embodiments of FIGS. 8 to 10 are substantially the same as the structure of the embodiment of FIG. 1.

The embodiments of FIGS. 8 to 10 will be described in detail below. The magnetic field device 3 formed of a permanent magnet and the vortex chamber 5B are disposed so as to be arranged in a vertical direction in FIG. 1 in the embodiment of FIG. 1, but are disposed so as to be arranged in a lateral direction in FIGS. 8 and 9 in the embodiments of FIGS. 8 and 9. However, the embodiments of FIGS. 8 to 10 and the embodiment of FIG. 1 are substantially the same except for a difference in the path of the outflow channel 5C. Accordingly, the detailed description of components of FIGS. 8 and 9, which are the same as the components of the embodiment of FIG. 1, will be omitted.

First, in the embodiment of FIG. 8, as in the embodiment of FIG. 1, an upstream portion of the flow channel 5 including the inlet 5*a* and the outlet 5*b* forms a driving flow channel 5A a downstream portion of the flow channel 5 forms an outflow channel 5C, and a vortex chamber 5B is formed in the middle of the flow channel 5. The driving flow channel 5A and the outflow channel 5C three-dimensionally cross each other, as known from FIG. 8.

The outflow channel 5C is formed so that a substantially middle portion of the outflow channel 5C is curved along the magnetic field device 3 formed of a permanent magnet. Accordingly, when the magnetic field device 3 formed of a permanent magnet is rotated counterclockwise in FIG. 8 as illustrated in FIG. 8, the molten metal M present in the outflow channel 5C is driven by an electromagnetic force and flows into the holding furnace 2. That is, molten metal M is sucked from the vortex chamber 5B. A suction force cooperates with a pressing force generated in the driving flow channel 5A, so that molten metal M reliably flows into the vortex chamber 5B and reliably flows out of the vortex chamber 5B. That is, since molten metal M is pulled out from the point of view of the vortex chamber 5B, molten metal M more smoothly flows into the vortex chamber 5B. Accordingly, molten metal M is more strongly rotated in the vortex chamber 5B in the form of a stronger vortex, so that materials can be more reliably and quickly melted.

Meanwhile, in the embodiment of FIG. 8, the driving flow channel 5A and the outflow channel 5C are formed so as to extend in an arc shape along the circumference of the magnetic field device 3 formed of a permanent magnet. However, instead of this, the driving flow channel 5A and the outflow channel 5C may be formed so as to be wound around the magnetic field device 3 once or an arbitrary number of times. That is, at least one of the driving flow channel 5A and the outflow channel 5C includes a winding portion (ring-shaped flow channel portion) formed in the shape of a coil and may be adapted so that the winding portion is wound around the magnetic field device 3 formed of a permanent magnet. In this case, actually, various structures can be employed so that the driving flow channel 5A and the outflow channel 5C do not interfere with each other. For example, a so-called double-threaded screw structure in which the driving flow channel 5A and the outflow channel 5C are wound around the magnetic field device 3 so as to be adjacent to each other, a structure in which the driving flow channel 5A is wound around a lower half (or an upper half) of the height of the magnetic field device 3 formed of a permanent magnet a plurality of times and the outflow channel 5C is wound around an upper half (or a lower half) thereof a plurality of times, and the like can be employed. A structure in which the driving flow channel 5A and the outflow channel 5C are wound around the magnetic field device 3 formed of a permanent magnet as described above can also be employed in not only the above-mentioned embodiment of FIG. 1 but also embodiments to be described below.

The embodiment of FIG. 9 is a modification of the embodiment of FIG. 8. The embodiment of FIG. 9 is different from the embodiment of FIG. 8 in that the driving flow channel 5A and the outflow channel 5C are arranged side by side (that is, are parallel) in plan view without three-dimensionally crossing each other. For this reason, positions where the driving flow channel 5A and the outflow channel 5C communicate with the vortex chamber 5B vary in FIGS. 8 and 9. Accordingly, molten metal M forms a clockwise vortex in FIG. 8 in the vortex chamber 5B in the embodiment of FIG. 8, and molten metal M forms a counterclockwise vortex in FIG. 9 in the vortex chamber 5B in the embodiment of FIG. 9.

The embodiment of FIG. 10 is an embodiment as a modification of the embodiment of FIG. 1, and the driving flow channel 5A and the outflow channel 5C three-dimensionally cross each other as in the embodiment of FIG. 8. Further, in the embodiment of FIG. 10, the outlet 5*b* is provided at a position closer to the inlet 5*a* than that of the embodiment of FIG. 1.

The invention claimed is:

1. A conductive metal melting furnace that melts a raw material of conductive metal to form a molten metal, the conductive metal melting furnace comprising:

a flow channel that includes an inlet through which the molten metal flows into the flow channel from outside and an outlet through which the molten metal is discharged to the outside; and a magnetic field device formed of a permanent magnet that includes a permanent magnet and is rotatable about a vertical axis, wherein the flow channel includes a driving flow channel that is provided on an upstream side, an outflow channel that is provided on a downstream side, and a vortex chamber that is formed between the driving flow channel and the outflow channel;

the driving flow channel is provided at a providing position, which is a position at which lines of magnetic force of the magnetic field device are moved with rotation of the magnetic field device while passing through the molten metal present in the driving flow channel, and a position at which the molten metal is allowed to flow into the vortex chamber by an electromagnetic force generated with movement of the lines of magnetic force to generate vortex of the molten metal in the vortex chamber;

the outflow channel is provided at another providing position, which is a positon at which lines of magnetic force of the magnetic field device are moved with the rotation of the magnetic field device while passing through the molten metal present in the outflow channel, and a position at which the molten metal is driven by an electromagnetic force generated with the movement of the lines of magnetic force so as to be sucked toward the outlet from the vortex chamber; and the magnetic field device is located between the driving flow channel and the outflow channel.

2. The conductive metal melting furnace according to claim 1, wherein at least one of the driving flow channel and the outflow channel includes an arc-shaped portion that is curved in an arc shape.

3. The conductive metal melting furnace according to claim 2, wherein the magnetic field device is provided adjacent to the arc-shaped portion of at least one of the driving flow channel and the outflow channel.

4. The conductive metal melting furnace according to claim 1, wherein at least one of the driving flow channel and the outflow channel includes a winding portion which is wound around the magnetic field device.

5. The conductive metal melting furnace according to claim 1, wherein the vortex chamber includes a vortex chamber inlet that allows the molten metal to flow into the vortex chamber from the driving flow channel, and a vortex chamber outlet that allows the molten metal to flow out of the vortex chamber to the outflow channel, and the vortex chamber inlet has a height higher than that of the vortex chamber outlet.

6. The conductive metal melting furnace according to claim 5, wherein the vortex chamber outlet is formed at a position shifted from center of the vortex chamber in plain view.

7. The conductive metal melting furnace according to claim 1, wherein the vortex chamber is formed so that an upper side of the vortex chamber is opened.

8. The conductive metal melting furnace according to claim 1, wherein the magnetic field device includes one permanent magnet.

9. The conductive metal melting furnace according to claim 1, wherein the magnetic field device includes a plurality of permanent magnets that are arranged in a circumferential direction and are arranged so that poles of the permanent magnets adjacent to each other in the circumferential direction are different from each other.

10. A conductive metal melting system, comprising:

the conductive metal melting furnace according to claim 1; and a holding furnace that stores the molten metal, wherein the inlet and the outlet of the conductive metal melting furnace communicate with an outflow port and an inflow port, which are formed in a side wall of the holding furnace, respectively.

11. A conductive metal melting method that melts a raw material of conductive metal to form a molten metal, the conductive metal melting method comprising:

rotating a magnetic field device formed of a permanent magnet, which includes a permanent magnet, about a vertical axis, wherein the magnetic field device is located between a driving flow channel and an outflow channel of a flow channel that further includes an inlet through which the molten metal flows into the flow channel from outside, an outlet through which the molten metal is discharged to the outside, and a vortex chamber between the driving flow channel provided on an upstream side and the outflow channel provided on a downstream side;

moving lines of magnetic force of the permanent magnet while the lines of magnetic force of the permanent magnet pass through the molten metal present in the driving flow channel;

allowing the molten metal to flow into the vortex chamber by an electromagnetic force generated with movement of the lines of magnetic force to generate vortex of the molten metal in the vortex chamber into which the raw material is to be put;

moving the lines of magnetic force of the permanent magnet while the lines of magnetic force of the permanent magnet further pass through the molten metal present in the outflow channel;

driving the molten metal present in the outflow channel toward the outlet by an electromagnetic force generated with the movement of the lines of magnetic force to allow the molten metal present in the vortex chamber to be sucked into the outflow channel; and discharging the molten metal to the outside from the outlet.

* * * * *